US007446515B2

(12) United States Patent
Wang

(10) Patent No.: US 7,446,515 B2
(45) Date of Patent: Nov. 4, 2008

(54) COMPENSATING NMOS LDO REGULATOR USING AUXILIARY AMPLIFIER

(75) Inventor: Jianbao Wang, Tucson, AZ (US)

(73) Assignee: Texas Instruments Incorporated, Dallas, TX (US)

( * ) Notice: Subject to any disclaimer, the term of this patent is extended or adjusted under 35 U.S.C. 154(b) by 0 days.

(21) Appl. No.: 11/654,049

(22) Filed: Jan. 17, 2007

(65) Prior Publication Data

US 2008/0169795 A1 Jul. 17, 2008

Related U.S. Application Data

(60) Provisional application No. 60/824,208, filed on Aug. 31, 2006.

(51) Int. Cl.
*G05F 1/40* (2006.01)

(52) U.S. Cl. ..... 323/280; 323/275

(58) Field of Classification Search ..... 323/273, 323/274, 275, 276, 280
See application file for complete search history.

(56) References Cited

U.S. PATENT DOCUMENTS 5,982,226 A * 11/1999 Rincon-Mora ..... 323/280
6,861,827 B1 * 3/2005 Yang et al. ..... 323/273
7,015,680 B2 * 3/2006 Moraveji et al. ..... 323/274

* cited by examiner

*Primary Examiner*—Jessica Han
(74) *Attorney, Agent, or Firm*—Wade J. Brady, III; Frederick J. Telecky, Jr.

(57) ABSTRACT

An LDO (low dropout) regulator including a pass transistor having a first electrode coupled to produce an output voltage of the LDO regulator, a control electrode, and a second electrode coupled to receive an input voltage of the LDO regulator. An error amplifier has a first input coupled to a first reference voltage and an output coupled to the gate control electrode of the pass transistor. A first feedback circuit has an input coupled to the first electrode of the pass transistor and an output producing a first feedback voltage coupled to a second input of the error amplifier. The auxiliary amplifier has a first input coupled to a second reference voltage and an output coupled to the output of the error amplifier. A second feedback circuit has an input coupled to the output of the auxiliary amplifier and an output producing a second feedback voltage coupled to a second input of the auxiliary amplifier. The auxiliary feedback loop is used to take over control of the feedback in the LDO regulator at high frequencies.

20 Claims, 3 Drawing Sheets

COMPENSATING NMOS LDO REGULATOR USING AUXILIARY AMPLIFIER

This application claims priority from and incorporates by reference provisional patent Application No. 60/824,208, filed Aug. 31, 2006.

BACKGROUND OF THE INVENTION

The present invention relates generally to low dropout (LDO) voltage regulators which have stable operation and high phase margin over wide ranges of output capacitance and effective-series-resistance.

Referring to FIG. 1A, an NMOS LDO regulator 1A includes an error amplifier 2 having its (+) input coupled to receive a reference voltage Vref and its output voltage $V_g$ coupled by conductor 3 to the gate of an N-channel pass transistor 4, the drain of which receives the input voltage Vin which is to be regulated. The source of pass transistor 4 produces a regulated output voltage Vout that is coupled by an output conductor 5 to a load capacitor 11 of capacitance $C_L$ to a load $I_L$ represented by a current source 7 and to the first terminal of a resistor 9. The second terminal of resistor 9 is connected by a feedback conductor 6 to a first terminal of a second resistor 10 having its second terminal connected to ground. Resistors 9 and 10 form a voltage divider, from which a feedback signal on conductor 6 is applied to the (−) input of error amplifier 2.

The transconductance $g_{mi}$ of error amplifier 2 in FIG. 1A and the gate capacitance $C_g$ of pass transistor 4 set the bandwidth of the loop to be equal to $g_{mi}/C_g$. NMOS LDO regulators as shown in FIG. 1A generally do not need a load capacitor for stability. Load capacitors nevertheless are used in most applications to help improve transient performance of the LDO regulator, as capacitors can supply instantaneous current in the event of a load transient. Due to the finite transconductance $g_{mo}$ of pass transistor 4, the load capacitance $C_L$ causes a second pole at the frequency $g_{mo}/C_L$ (in radians). For a given output capacitor $C_L$, the second pole can be considered to "slide" upward along the −20 dB/decade line 30-2 as indicated in the Bode plot of FIG. 3 when the load current $I_L$ decreases. This causes a decrease of the phase margin of LDO regulator 1A as the second pole moves away from the 0 dB line 34 and may result in circuit instability.

Therefore, it usually is recommended that high ESR (effective-series-resistance) output capacitors, such as tantalum capacitors, be used for NMOS LDO regulators in order to provide a "zero" to cancel the second pole. However, the use of high ESR tantalum output capacitors compromises the transient performance of the LDO regulator and also may result in capacitor reliability problems because of joule heating effects of the ES are caused by the transient current.

As progress continues to be made in reducing the size and cost of ceramic capacitors, it is very important for an integrated circuit LDO regulator to be stable when used with a low ES are ceramic output capacitor in order to achieve a good level of success in the market.

FIG. 1B shows another NMOS LDO voltage regulator topology which has been attempted to solve the instability problem in the assignee's TPS731 product, wherein the signal $V_g$ on the gates of the N-channel transistor 14 and the N-channel pass transistor 4 is coupled to the source of transistor 14 and then is AC-coupled by feedback capacitor $C_f$ and conductor 6A to the (−) input of the error amplifier 2. Transistor 14 provides another feedback path in which the signal is not affected by the load capacitance $C_L$. However, this topology was not implemented in the above mentioned TPS731 product for two reasons. First, the topology was found to be impractical because $C_f$ and $R_f$ need to be large and therefore require too much die area for the signal path to be effective. Second, $R_f$ can not be too large because that would result in too much noise. Nevertheless, the idea of a parallel AC-coupled feedback path is very valuable for LDO loop compensation design.

There is an unmet need for an integrated circuit LDO voltage regulator which can be used with a load capacitor of low effective-series-resistance (ESR) having improved stable operation and high phase margin compared to the prior art, in order to avoid reliability problems due to joule heating effects caused by transient current in the load capacitor.

SUMMARY OF THE INVENTION

It is an object of the invention to provide a reliable integrated circuit LDO voltage regulator circuit and method which provide stable operation and high phase margin over wide ranges of effective-series-resistance (ESR) load capacitance values.

It is another object of the invention to provide a reliable integrated circuit LDO voltage regulator which has stable operation and high phase margin over a wide range of low to high effective-series-resistance (ESR) output capacitance values and which avoids reliability problems due to joule heating effects caused by transient current on the ESR of a load capacitor.

It is another object of the invention to provide an integrated circuit LDO voltage regulator that can be used with a load capacitor of low effective-series-resistance having improved stable operation and high phase margin compared to the prior art, in order to avoid reliability problems due to joule heating effects caused by the transient current in the load capacitor.

Briefly described, and in accordance with one embodiment, the present invention provides an LDO (low dropout) regulator (25) including a pass transistor (4) having a first electrode coupled to produce an output voltage (Vout) of the LDO regulator (25), a control electrode, and a second electrode (8) coupled to receive an input voltage (Vin) of the LDO regulator (25). An error amplifier (2) has a first input coupled to a first reference voltage (Vref) and an output coupled to the control electrode of the pass transistor (4). A first feedback circuit (9,10) has an input coupled to the first electrode of the pass transistor (4) and an output (6) producing a first feedback voltage ($V_{FB1}$) coupled to a second input of the error amplifier (2). The auxiliary amplifier (15) has a first input coupled to a second reference voltage (GND) and an output coupled to the output (3) of the error amplifier (2). A second feedback circuit has an input coupled to the output of the auxiliary amplifier (15) and an output (17) producing a second feedback voltage ($V_{FB2}$) coupled to a second input of the auxiliary amplifier (15). The auxiliary loop takes over control of the feedback in the LDO regulator at high frequencies. The output (3) of the error amplifier (2) can be, but is not necessarily directly coupled to the control electrode of the pass transistor (4). In the described embodiment, the second feedback circuit includes an AC feedback path operative to track a transfer characteristic pole associated with a load capacitance ($C_L$) so as to provide at least a predetermined phase margin over a wide range of loading of the LDO regulator.

In one embodiment, the second feedback circuit includes a feedback transistor (14) having a control electrode coupled to the output (3) of the auxiliary amplifier (15), a first electrode coupled to an input of a high pass filter (18,19), and a second electrode coupled to receive the input voltage (Vin) of the LDO regulator (25). The pass transistor (4) and the feedback transistor (14) can be field effect transistors. In the described embodiment, the pass transistor (4) is an N-channel MOS field effect transistor. The transconductance ($g_{mi}$) of the error amplifier (2) should be substantially greater than a transconductance ($g_{ma}$) of the auxiliary amplifier (15). In one embodiment, the error amplifier (2) includes a first PMOS differential input stage (2A) having outputs coupled to corresponding inputs of a folded-cascode stage (2B), and wherein the auxiliary amplifier (15) includes a second CMOS differential input stage (15A) having outputs also coupled to the corresponding inputs of the folded-cascode stage (2B).

In one embodiment, the second feedback circuit includes a high pass filter circuit (18,19) having an input (20) coupled to the output (3) of the auxiliary amplifier (15) and an output (17) coupled to the second input of the auxiliary amplifier (15). The high pass filter circuit (18,19) may include a variable resistor (18) having a control electrode coupled to receive a control voltage ($V_{18A}$) representative of a value of a load current ($I_L$). The variable resistor (18) may, for example, include a N-channel MOS transistor having a gate coupled to receive the control voltage ($V_{18A}$).

In the described embodiments, the second feedback circuit is operative to substantially take control of overall feedback operation in the LDO regulator at frequencies greater than a predetermined frequency equal to $g_{mo}/C_L$, wherein $g_{mo}$ is the transconductance of the pass transistor (4) and $C_L$ is a capacitive load driven by the pass transistor (4). The second feedback circuit provides the predetermined phase margin in accordance with the expression $$90\text{ degrees}-(180\text{ degrees}/\pi)\{\tan^{-1}[(g_{mi}/g_{ma})^{1/2}]+\tan^{-1}[(g_{ma}/g_{mi})^{1/2}]\},$$

where $g_{mi}$ is the transconductance of the error amplifier (2) and $g_{ma}$ is the transconductance of the auxiliary amplifier (15).

In one embodiment, the invention provides a method of operating a LDO (low dropout) regulator (25) which includes a pass transistor (4), an error amplifier (2) having a first input coupled to a first reference voltage (Vref) and an output coupled to a control electrode of the pass transistor (4), a first feedback circuit (9,10) having an input coupled to a first electrode of the pass transistor (4) and an output (6) coupling a first feedback voltage ($V_{FB1}$) to a second input of the error amplifier (2), including applying an input voltage (Vin) to a second electrode (8) of the pass transistor (4), applying a second reference voltage (GND) to a first input of an auxiliary amplifier (15), coupling an output of the auxiliary amplifier (15) to the output (3) of the error amplifier (2), producing a second feedback voltage ($V_{FB2}$) by means of a second feedback circuit having an input coupled to the output (3) of the auxiliary amplifier (15) and an output (17) coupled to a second input of the auxiliary amplifier (15), and operating the second feedback circuit to control overall feedback operation in the LDO regulator a frequency above a predetermined frequency. An AC feedback path in the second feedback circuit is operated to track a transfer characteristic pole associated with a load capacitance ($C_L$) so as to provide at least a predetermined phase margin over a wide range of loading of the LDO regulator.

In one embodiment, the invention provides an LDO regulator (25) including a pass transistor (4), an error amplifier (2) having a first input coupled to a first reference voltage (Vref) and an output coupled to a control electrode of the pass transistor (4), a first feedback circuit (9,10) having an input coupled to a first electrode of the pass transistor (4) and an output (6) coupling a first feedback voltage ($V_{FB1}$) to a second input of the error amplifier (2), and input voltage (Vin) being applied to a second electrode (8) of the pass transistor (4) and a second reference voltage (GND) being applied to a first input of an auxiliary amplifier (15). This embodiment also includes means (3) for coupling an output of the auxiliary amplifier (15) to the output (3) of the error amplifier (2), means (18,19) for producing a second feedback voltage ($V_{FB2}$) in response to the output (3) of the auxiliary amplifier (15), means (17) for coupling the second feedback voltage ($V_{FB2}$) to a second input of the auxiliary amplifier (15), and means (19) for operating the second feedback circuit to control overall feedback operation in the LDO regulator a frequency above a predetermined frequency.

DETAILED DESCRIPTION OF THE PREFERRED EMBODIMENTS

Figure 1A:
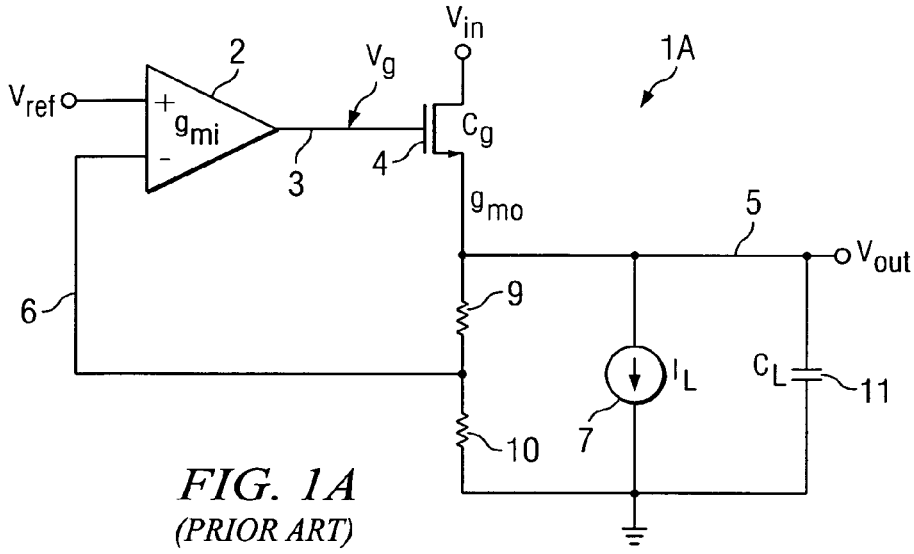
FIG. 1A (PRIOR ART)
FIG. 1A is a schematic diagram of a conventional NMOS linear voltage regulator.
Figure 1B:
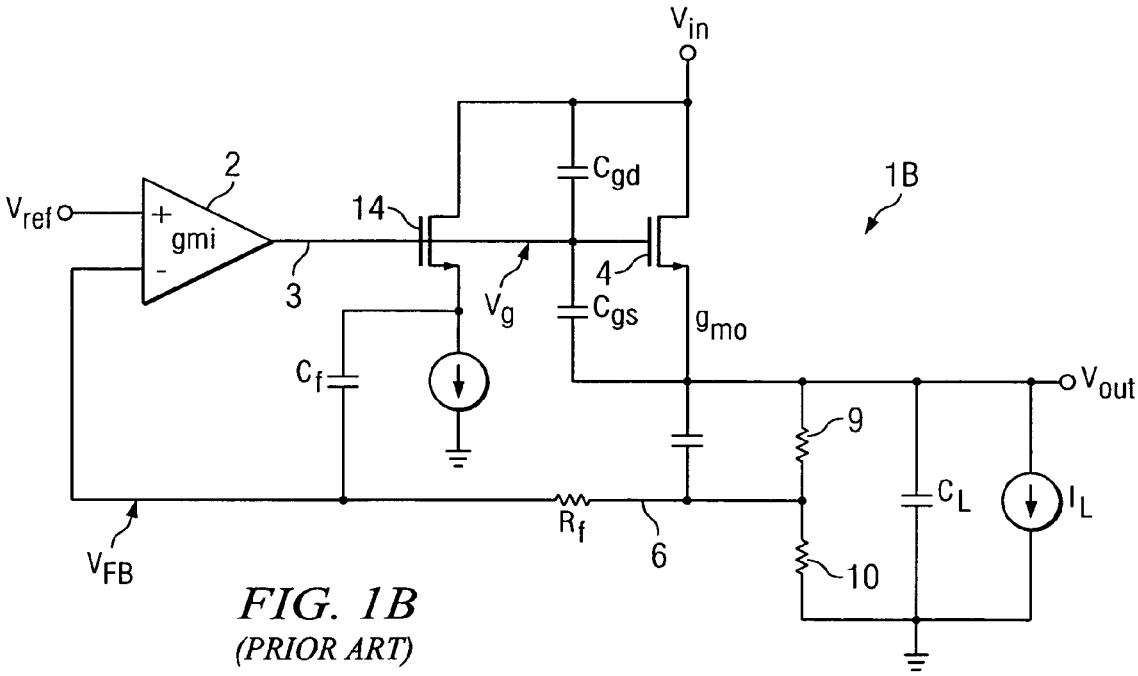
FIG. 1B (PRIOR ART)
FIG. 1B is a schematic diagram of an NMOS linear voltage regulator with a parallel AC feedback path.
Figure 2:
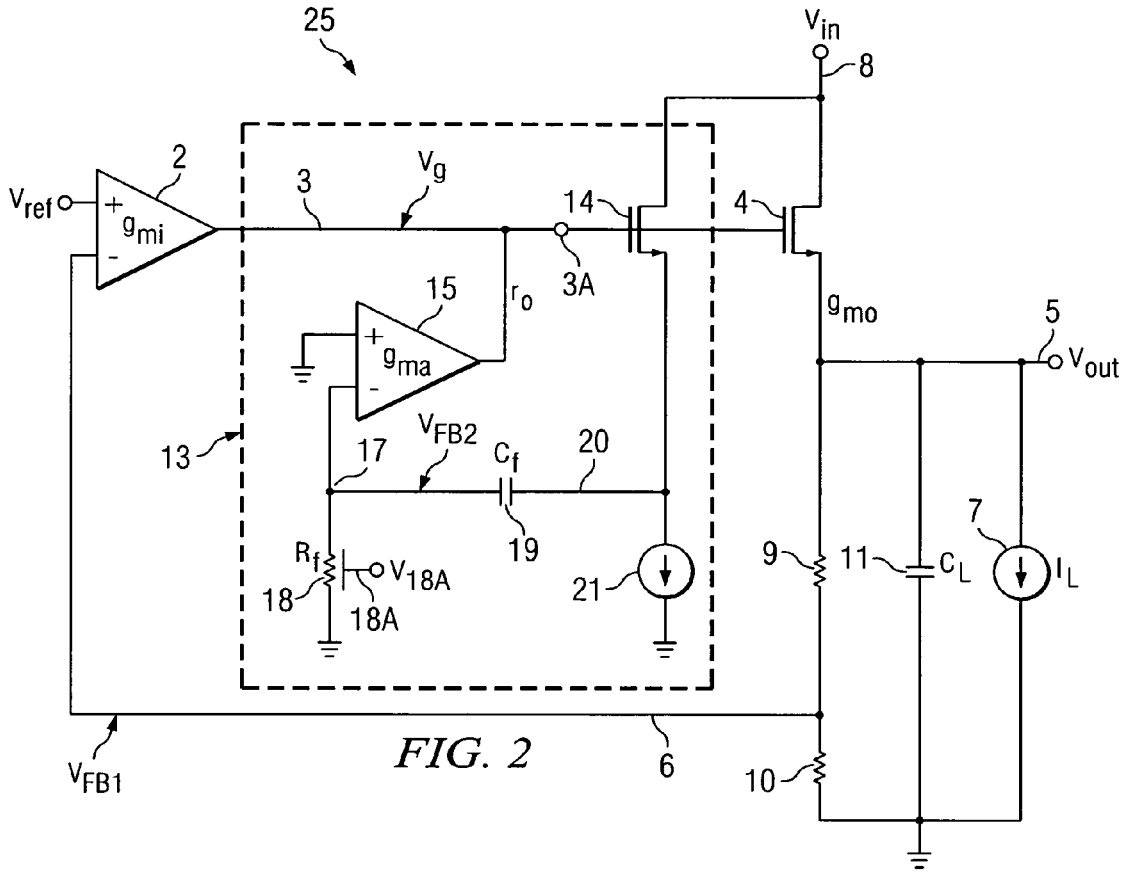
FIG. 2 is a schematic diagram of an NMOS linear regulator which includes an auxiliary gain loop in accordance with the present invention.

Referring to FIG. 2, LDO regulator 25 includes an error amplifier 2 having its (+) input coupled to receive reference voltage Vref and its output Vout coupled by conductor 3 to the gate of N-channel pass transistor 4, the drain of which receives unregulated input voltage Vin. The transconductance of error amplifier 2 is $g_{mi}$, and the output impedance on conductor 3 is $r_o$. The transconductance of pass transistor 4 is $g_{mo}$. The source of pass transistor 4 produces a regulated output voltage Vout, which can be coupled by output conductor 5 to a load capacitor 11 having a capacitance $C_L$, a load represented by a current source 7 conducting a load current $I_L$, and a voltage divider including a first resistor 9 having a first terminal connected to output conductor 5 and a second terminal connected by feedback conductor 6 to a first terminal of a second resistor 10 having its second terminal connected to ground. A feedback signal $V_{FB1}$ on conductor 6 is applied to the (−) input of error amplifier 2.

In accordance with the present invention, an auxiliary feedback loop circuit 13 is included, for the purpose of "taking over" the feedback loop from the "main" feedback loop (which includes error amplifier 2) at high frequencies in order to achieve stability of LDO regulator circuit 25. Auxiliary feedback loop circuit 13 includes an auxiliary amplifier 15 of transconductance $g_{ma}$ of N-channel feedback transistor 14, current source 21, and a high pass filter including resistor 18 of resistance $R_f$ and capacitor 19 of capacitance $C_f$. The (+) input of auxiliary amplifier 15 is connected to ground, and its output is connected by conductor 3 to the output of error amplifier 2 and the gates of pass transistor 4 and feedback transistor 14. The drain of feedback transistor 14 is connected to Vin, and its source is connected by conductor 20 to one terminal of filter current source 21 and to one terminal of filter capacitor 19. The other terminal of filter capacitor 19 is connected by conductor 17 to one terminal of resistor 18 and to the (−) input of auxiliary amplifier 15. The other terminal of filter resistor 18 is connected to ground. A feedback voltage $V_{FB2}$ produced on conductor 17 is coupled to the (−) input of auxiliary amplifier 15. As subsequently explained, filter resistor 18 may be a variable resistor having a control electrode 18A to which a control voltage $V_{18A}$ is applied.

Figure 5:
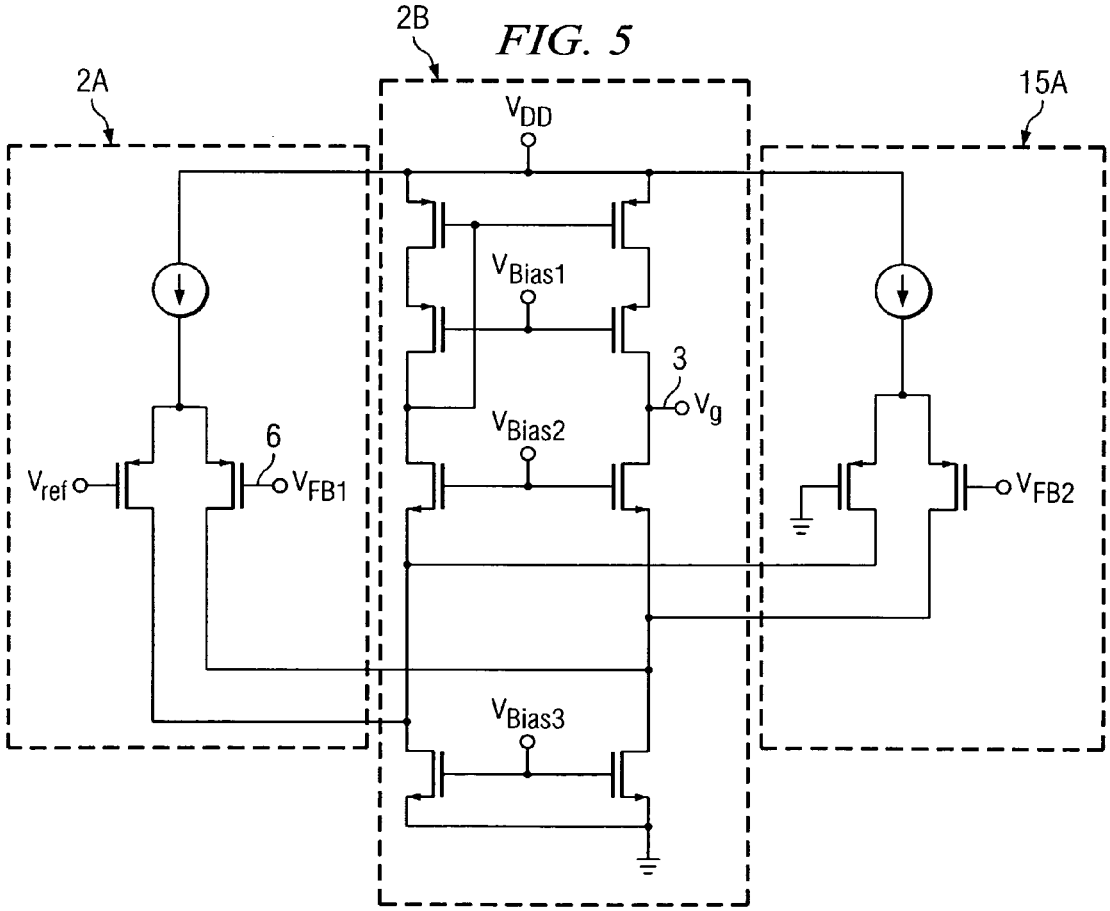
FIG. 5 is a detailed schematic diagram of the error amplifier and auxiliary amplifier of FIG. 2.

Referring to FIG. 5, a more detailed schematic diagram is shown which includes both error amplifier 2 and auxiliary amplifier 15 of FIG. 2. Specifically, FIG. 5 shows a pair of differentially coupled P-channel input transistors 2A which constitute the input stage of error amplifier 2, and also shows another pair of differentially coupled P-channel input transistors 15A which constitute the input stage of auxiliary amplifier 15 in FIG. 2. The outputs of both error amplifier input stage 2A and auxiliary amplifier input stage 15A are connected to the single folded cascode current mirror stage 2B. Folded cascode stage 2B sums the current signals from both input pairs 2A and 15A and applies the current signal on conductor 3 to the gates of pass transistor 4 and feedback transistor 14 (FIG. 2). The large gate capacitances of transistors 4 and 14 provide compensation for the amplifiers 2 and 15.

Referring to FIGS. 2-5, in order to investigate the stability of the circuit with both a main feedback loop and a parallel auxiliary feedback loop, the main loop (which includes error amplifier 2) and the auxiliary loop (which includes auxiliary amplifier 15) are analyzed separately. The open loop DC gain of the main loop is given by $$\text{Open Main Loop } DC \text{ Gain}=g_{mi}\times r_o, \qquad \text{Equation (1)}$$

where $r_o$ is the output resistance of the current mirror included in folded cascode stage 2B and, together with the total gate capacitance $C_g$, the quantity $1/(r_o\times C_g)$ defines the location of the dominant pole, causing the main loop gain to roll off at −20 DB/decade at higher frequencies. This is depicted as the section 30-2 of the Bode plot of FIG. 3. The gain bandwidth product of the main loop is $g_{mi}/C_g$. If an output (i.e., load) capacitor 11 of capacitance $C_L$ is presented, the main loop transfer characteristic becomes a two-pole system as $C_L$ introduces a second pole located at $g_{mo}/C_L$, which moves, as indicated by arrows 33, along the main loop roll-off section or "rail" 30-2 as the load current $I_L$ varies. In the auxiliary loop, the signal $V_g$ on the gate of feedback transistor 14 is reproduced on conductor 20, passes through high-pass filter 18,19 in FIG. 2, and then drives the (−) input of auxiliary amplifier 15. At very low frequencies the feedback signal $V_{FB2}$ appearing at the (−) input of auxiliary amplifier 15 is given by the expression $$V_{FB2}=sC_f\times R_f V_g, \qquad \text{Equation (2)}$$

which leads to open auxiliary loop gains indicated by the expressions $$g_{ma}\times r_o\times sC_f\times R_f, \text{ for } \omega<1/(C_g\times r_o), \text{ and}$$

$$g_{ma}\times C_f\times R_f/Cg, \text{ for } \omega>1/(C_g\times r_o), \qquad \text{Equations (3)}$$

where "s" is the complex variable frequency.

At high frequencies, the high-pass filter capacitor $C_f$ acts as a short, and the open auxiliary loop gain is given by $$\text{Auxiliary open loop gain}=g_{ma}/(sC_g), \qquad \text{Equation (4)}$$

for $\omega>1/(C_fR_f)$. The frequency response of auxiliary loop 13 is depicted by the dashed line curve 32 in the Bode plot of FIG. 3.

The overall response for both the main loop and the auxiliary loop can be obtained using the principle of superposition. At very low frequencies, the main loop is dominant and the overall loop response follows the main loop characteristics. At a frequency higher than $g_{mo}/C_L$, the main loop response rolls off at −40 dB/decade as indicated, for example, by section 30-3A. However, the main loop still keeps its dominance and the overall loop response stays on curve 30-3A at −40 DB/decade, until it intersects the auxiliary loop response at a frequency $\omega_z$ which can be derived as:

$$\omega_z=(g_{mi}/g_{ma})(g_{mo}/C_L). \qquad \text{Equation (5)}$$

Above the frequency $\omega_z$, the main loop 2,4,9,10 yields its dominance to the auxiliary loop 15,14,20,18,19, which brings the overall loop response back to −20 dB/decade roll-off for curve section 32-4.

Figure 3:
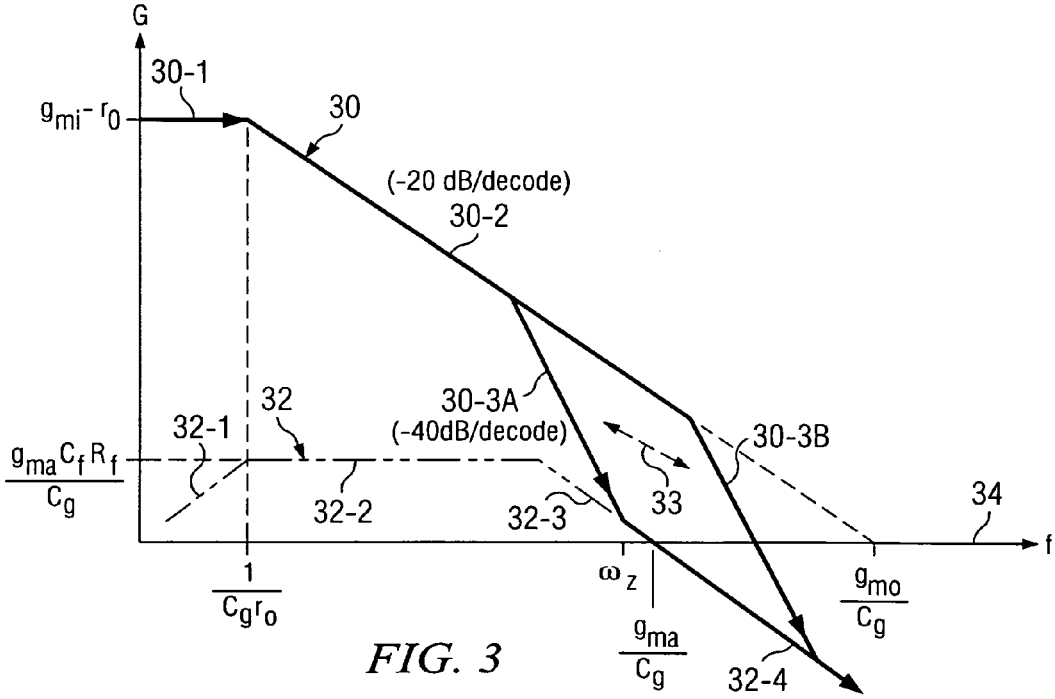
FIG. 3 shows a Bode plot illustrative of the operation and advantages of the NMOS linear regulator shown in FIG. 2.

It can be seen from Equation (2) and FIG. 3 that the location of the "zero" tracks the location of the second pole and the −40 dB/decade segment "slides", as indicated by arrows 33, along the two parallel −20 dB/decade sections or "rails" 30-2 and 30-4 when the load current $I_L$ or the output capacitance $C_L$ changes. Stability is ensured if the load is so "light" that the −40 dB/decade segment (such as 30-3A or 30-3B) "slides" upward and the $\omega_z$ intersection shown in FIG. 3 moves above the unity gain line 34. Stability also is ensured if the load is so "heavy" that the −40 dB/decade segment "slides" downward and $g_{mo}/C_L$ moves below the unity gain line 34. The worst case phase margin PM occurs when the unity gain line 34 passes through the mid point of the −40 dB/decade segment, which can be derived as:

$$\text{PM}=90 \text{ degrees}-(180 \text{ degrees}/\pi)\{\tan^{-1}[(g_{mi}/g_{ma})^{1/2}]+\tan^{-1}[(g_{ma}/g_{mi})^{1/2}]\}, \qquad \text{Equation (6)}$$

where the term (180 degrees/π) converts radians to degrees, and where $\omega_m$ is the unity gain frequency and is given by $$\omega_m=(\omega_z g_m/C_L)^{1/2}=(g_{mi}/g_{ma})^{1/2}(g_{mo}/C_L). \qquad \text{Equation (7)}$$

By using Equation (7), Equation (6) can be simplified to:

$$\text{PM}=90 \text{ degrees}-(180 \text{ degrees}/\pi)\{\tan^{-1}[(g_{mi}/g_{ma})^{1/2}]-\tan^{-1}[(g_{ma}/g_{mi})^{1/2}]\}. \qquad \text{Equation (8)}$$

Figure 4:
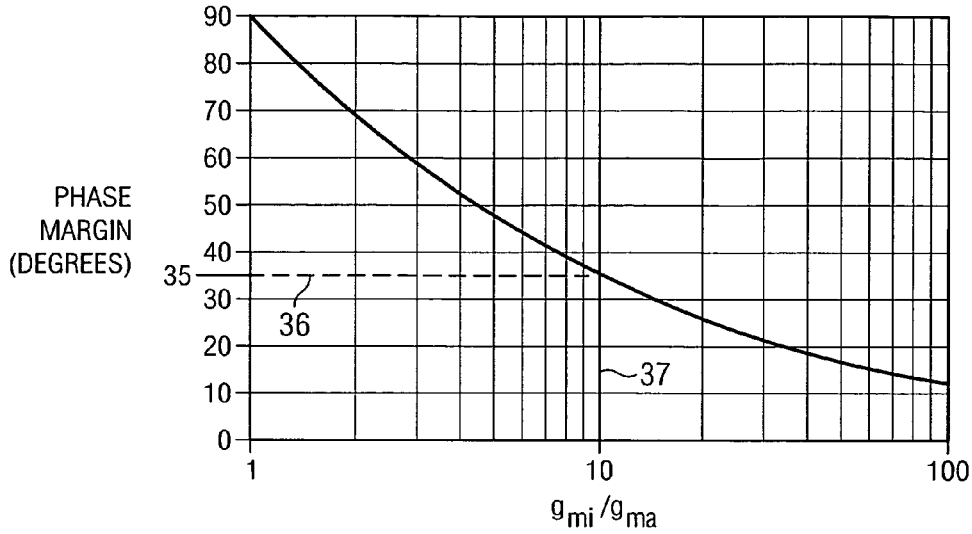
FIG. 4 is a plot showing the worst case phase margin of the NMOS linear regulator of FIG. 2 versus the ratio of the transconductances of the main and auxiliary amplifiers.

A plot of the worst case phase margin (PM) vs. the ratio of the transconductance of error amplifier 2 to that of auxiliary amplifier 15 is shown in FIG. 4, from which a worst-case phase margin of 35 degrees is obtained for $g_{mi}/g_{ma}=10$, as indicated by horizontal line 36 and vertical line 37.

From FIG. 4 it can be seen that if the error amplifier 2 and auxiliary amplifier 15 were to have equal gains, the worst case phase margin would be 90 degrees (π/2). This can be readily understood by considering that in the Bode plot of FIG. 3, if $g_{mi}=g_{ma}$, the −20 dB/decade frequency responses for the main loop and the auxiliary loop coincide and the −40 dB/decade segment vanishes completely so that a complete pole-zero cancellation is realized. However, it should be noted that there are several design considerations preventing the use of too much gain in the auxiliary amplifier loop.

Using the error amplifier and the auxiliary amplifier with an equal transconductance to achieve a complete pole-zero cancellation would be impractical because auxiliary amplifier 15 would reduce the transient response speed of LDO regulator 25. This can be illustrated by considering the case wherein a large transient load is imposed on output conductor 5, which would cause Vout to "dip", producing a disturbance that would be fed back to the (−) input of error amplifier 2. Error amplifier 2 would respond by injecting current into conductor 3 in order to increase the drive voltage $V_g$ on the gates of feedback transistor 14 and pass transistor 4 to restore Vout to its balanced value. However, the increase of the gate voltage $V_g$ would unbalance the auxiliary feedback loop, causing auxiliary amplifier 15 to counter-act by sinking current out of conductor 3 in an effort to restore the balance in auxiliary feedback loop 13. This counter-action would significantly delay the re-balancing of the main feedback loop and result in very large overshoot and undershoot of Vout if the gain of auxiliary amplifier were too large.

Apart from the problem mentioned above, some performance requirements, such as low noise and low offset, require the use of a "weak" auxiliary amplifier 15. Also, using a "strong" auxiliary amplifier 15 would increase the quiescent current and the integrated circuit area.

If a "light" load driven by LDO regulator 25 decreases further, the pole associated with load capacitance $C_L$ moves upward in FIG. 3 and the −40 dB/decade segment may intersect the level portion 32-2 of the transfer curve 32 of auxiliary feedback loop 13, resulting in a gain notch at the intersecting frequency and causing a stability problem. This is like a "derailing" at the corner of segments 32-3 and 32-2 in FIG. 3. In order for the "sliding" −40 dB/decade segment as indicated by arrows 33 to avoid "derailing" from transfer characteristic 32, feedback resistor $R_f$ may be made adaptive to output current $I_L$, for example by using an N-channel MOS resistor, so that its resistance increases while the output current $I_L$ decreases, which extends up the rail 32-3 and prevents the "derailing" when the −40 dB/decade segment "slides" upward as indicated by arrows 33. In FIG. 2, feedback resistor 18 is illustrated as a variable resistor with a control electrode connected to conductor 18A. A control voltage $V_{18A}$ is applied to the control electrode of the variable feedback resistor 18 by a control circuit (not shown) which, if feedback resistor 18 is a N-channel MOS transistor, decreases the magnitude of $V_{18A}$ in response to decreasing output current $I_L$ so as to avoid the above-mentioned "derailing". By applying an output current sample taken at, for example, 1:1000 scale onto another diode-connected N-channel transistor to obtain $V_{18A}$ from its gate-source voltage, the MOS resistor driven by $V_{18A}$ is inversely proportional to $(I_L)^{1/2}$, which tracks $g_{mo}$ precisely, as $g_{mo}$ is proportional to $(I_L)^{1/2}$ when the pass device operates in its saturation region.

In summary, by using a parallel AC feedback path and an auxiliary amplifier, a zero is created to track the second pole associated with the load capacitance $C_L$, and provides a minimum phase margin of 35 degrees over wide ranges of load current $I_L$ and load capacitance $C_L$. Moreover, the loop stability of LDO regulator circuit 25 of FIG. 2 is insensitive to the ESR (effective-series-resistance) of load capacitor 11. This gives the described NMOS LDO design a great advantage in the market, because in some NMOS LDO regulator designs a minimum value of the ESR of the output capacitor 11 is required to ensure circuit stability, while, in other designs having a "zero" created inside the LDO regulator circuit to cancel the pole caused by the output capacitor 11, there are stringent limitations on the combination of the load capacitance and its ESR to ensure circuit stability.

While the invention has been described with reference to several particular embodiments thereof, those skilled in the art will be able to make various modifications to the described embodiments of the invention without departing from its true spirit and scope. It is intended that all elements or steps which are insubstantially different from those recited in the claims but perform substantially the same functions, respectively, in substantially the same way to achieve the same result as what is claimed are within the scope of the invention. Conceptually, the basic technique and structure of the present invention also can be used in a PMOS LDO design. However, the design would not be as straight forward as in an NMOS LDO design, for two reasons. First, there is a voltage signal gain from the gate to the drain of a P-channel pass transistor, which would use its drain as the output. Second, the gain not only would vary with the load, but would also depend on what kind of load (i.e., resistive load or current source load) is used. Also, the basic structure and operation of the above described embodiments of the invention are also applicable to bipolar transistor implementations of an LDO regulator.

What is claimed is:

1. An LDO (low dropout) regulator comprising:

(a) a pass transistor having a first electrode coupled to produce an output voltage of the LDO regulator, a control electrode, and a second electrode coupled to receive an input voltage of the LDO regulator;

(b) an error amplifier having a first input coupled to a first reference voltage and an output coupled to the control electrode of the pass transistor;

(c) a first feedback circuit having an input coupled to the first electrode of the pass transistor and an output producing a first feedback voltage coupled to a second input of the error amplifier;

(d) an auxiliary amplifier having a first input coupled to a second reference voltage and an output coupled to the output of the error amplifier; and (e) a second feedback circuit having an input coupled to the output of the auxiliary amplifier and an output producing a second feedback voltage coupled to a second input of the auxiliary amplifier for taking over control of the feedback in the LDO regulator at high frequencies.

2. The LDO regulator of claim 1 wherein the output of the error amplifier is directly coupled to the control electrode of the pass transistor.

3. The LDO regulator of claim 1 wherein the second feedback circuit includes a feedback transistor having a control electrode coupled to the output of the auxiliary amplifier, a first electrode coupled to an input of a high pass filter, and a second electrode coupled to receive the input voltage of the LDO regulator.

4. The LDO regulator of claim 3 wherein the pass transistor and the feedback transistor are field effect transistors and wherein the control electrodes are gates, the first electrodes are sources, and the second electrodes are drains.

5. The LDO regulator of claim 1 wherein the pass transistor is an N-channel MOS field effect transistor, its control electrode being a gate, its first electrode being a source, and its second electrode being a drain.

6. The LDO regulator of claim 5 wherein the error amplifier includes a first PMOS differential input stage having outputs coupled to corresponding inputs of a folded-cascode stage, and wherein the auxiliary amplifier includes a second CMOS differential input stage having outputs also coupled to the corresponding inputs of the folded-cascode stage.

7. The LDO regulator of claim 1 wherein a transconductance of the error amplifier is substantially greater than a transconductance of the auxiliary amplifier.

8. The LDO regulator of claim 7 wherein the transconductance of the error amplifier is approximately 10 times greater than the transconductance of the auxiliary amplifier.

9. The LDO regulator of claim 1 wherein the second feedback circuit includes a high pass filter circuit having an input coupled to the output of the auxiliary amplifier and an output coupled to the second input of the auxiliary amplifier.

10. The LDO regulator of claim 9 wherein the high pass filter circuit includes a variable resistor having a control electrode coupled to receive a control voltage representative of a value of a load current.

11. The LDO regulator of claim 10 wherein the variable resistor includes a N-channel MOS transistor having a gate coupled to receive the control voltage.

12. The LDO regulator of claim 1 wherein the second feedback circuit is operative to substantially take control of overall feedback loop operation in the LDO regulator at high frequencies.

13. The LDO regulator of claim 12 wherein the second feedback circuit is operative to substantially take control of overall feedback operation in the LDO regulator at frequencies greater than a predetermined frequency equal to $g_{mo}/C_L$, wherein $g_{mo}$ is the transconductance of the pass transistor and $C_L$ is a capacitive load driven by the pass transistor.

14. The LDO regulator of claim 1 wherein the second feedback circuit includes an AC feedback path operative to track a transfer characteristic pole associated with a load capacitance so as to provide at least a predetermined phase margin over a wide range of loading of the LDO regulator.

15. The LDO regulator of claim 14 wherein the second feedback circuit provides the predetermined phase margin in accordance with the expression $$90\text{ degrees}-(180\text{ degrees}/\pi)\{\tan^{-1}[(g_{mi}/g_{ma})^{1/2}]+\tan^{-1}[(g_{ma}/g_{mi})^{1/2}]\},$$

where $g_{mi}$ is the transconductance of the error amplifier and $g_{ma}$ is the transconductance of the auxiliary amplifier.

16. A method of operating a LDO (low dropout) regulator which includes a pass transistor, an error amplifier having a first input coupled to a first reference voltage and an output coupled to a control electrode of the pass transistor, a first feedback circuit having an input coupled to a first electrode of the pass transistor and an output coupling a first feedback voltage to a second input of the error amplifier, the method comprising:

(a) applying an input voltage to a second electrode of the pass transistor;

(b) applying a second reference voltage to a first input of an auxiliary amplifier;

(c) coupling an output of the auxiliary amplifier to the output of the error amplifier;

(d) producing a second feedback voltage by means of a second feedback circuit having an input coupled to the output of the auxiliary amplifier and an output coupled to a second input of the auxiliary amplifier; and (e) operating the second feedback circuit to control overall feedback operation above a predetermined frequency in the LDO regulator.

17. The method of claim 16 including providing a transconductance of the error amplifier that is substantially greater than a transconductance of the auxiliary amplifier.

18. The method of claim 17 including operating an AC feedback path in the second feedback circuit to track a transfer characteristic pole associated with a load capacitance so as to provide at least a predetermined phase margin over a wide range of loading of the LDO regulator.

19. The method of claim 18 including controlling a resistance in a high pass filter circuit in the AC feedback path in response to a control voltage representative of a value of a load current.

20. An LDO (low dropout) regulator comprising:

(a) a pass transistor, an error amplifier having a first input coupled to a first reference voltage and an output coupled to a control electrode of the pass transistor, a first feedback circuit having an input coupled to a first electrode of the pass transistor and an output coupling a first feedback voltage to a second input of the error amplifier, and input voltage being applied to a second electrode of the pass transistor and a second reference voltage being applied to a first input of an auxiliary amplifier;

(b) means for coupling an output of the auxiliary amplifier to the output of the error amplifier;

(c) means for producing a second feedback voltage in response to the output of the auxiliary amplifier and an output and means for coupling the second feedback voltage to a second input of the auxiliary amplifier; and (d) means for operating the second feedback circuit to control overall feedback operation above a predetermined frequency in the LDO regulator.

* * * * *